United States Patent [19]

Healey et al.

[11] Patent Number: 4,969,284

[45] Date of Patent: Nov. 13, 1990

[54] SHOTGUN DISABLING DEVICE

[76] Inventors: Christopher T. Healey, 148 Longmore Lane, Sandiacre, Nottingham; Paul A. Fitzpatrick, Flat 2, 5 Wordsworth Road, West Bridgeford, Nottingham, both of United Kingdom

[21] Appl. No.: 413,107

[22] Filed: Sep. 27, 1989

[51] Int. Cl.[5] ..... F41A 17/44

[52] U.S. Cl. ..... 42/70.11; 42/96

[58] Field of Search ..... 42/70.11, 96

[56] References Cited

U.S. PATENT DOCUMENTS

| | | |
|---|---|---|
| 2,327,334 | 8/1943 | Parker . |
| 2,405,308 | 8/1946 | Jack . |
| 2,478,098 | 8/1949 | Hansen . |
| 2,479,107 | 8/1949 | Garretson . |
| 2,763,081 | 9/1956 | Huckabee . |
| 2,887,807 | 5/1959 | Santangelo . |
| 3,022,598 | 2/1962 | Wikstrom . |
| 3,137,957 | 6/1964 | Ingalls . |
| 3,360,880 | 1/1968 | Finnegan . |
| 3,378,943 | 4/1968 | Valburg . |
| 3,564,746 | 2/1971 | McConnell . |
| 3,708,901 | 1/1973 | Wolter . |
| 3,710,490 | 1/1973 | Cornett et al. . |
| 3,720,014 | 3/1973 | Goodrich . |
| 3,768,189 | 10/1973 | Goodrich . |
| 3,813,802 | 6/1974 | Di Prospero . |
| 4,010,565 | 3/1977 | Di Prospero . |
| 4,023,294 | 5/1977 | Knopp . |
| 4,100,693 | 7/1978 | Cech . |
| 4,136,476 | 1/1979 | Hetrick . |
| 4,224,753 | 9/1980 | Bielman . |
| 4,398,366 | 8/1983 | Wernicki . |
| 4,479,320 | 10/1984 | Fix . |
| 4,512,099 | 4/1985 | Mathew . |
| 4,569,144 | 2/1986 | Thurber . |
| 4,908,971 | 3/1990 | Chaney ..... 42/70.11 |

FOREIGN PATENT DOCUMENTS 2082293 3/1982 United Kingdom .

*Primary Examiner*—Charles T. Jordan
*Assistant Examiner*—Richard W. Wendtland
*Attorney, Agent, or Firm*—Varnum, Riddering, Schmidt & Howlett

[57] ABSTRACT

A disabling device for a shotgun comprises a generally elongate and rigid rod which has an opening therethrough towards a first end of the rod, and there being a cap secured to the second end of the rod, the cap having an outwardly extending flange, the rod being adapted to be received in a barrel of the shotgun by inserting the first end of the rod into a chamber end of the barrel and relatively moving longitudinally the barrel and the rod until the flange of the cap engages the chamber end of the barrel, with at least part of the opening at the first end of the rod extending from the muzzle end of the barrel, the cap comprising a sprung element which projects from an end of the cap to a position where the element would be struck by a hammer of the shotgun firing mechanism in the event that the firing mechanism is actuated with the disabling device received in the barrel.

8 Claims, 1 Drawing Sheet

SHOTGUN DISABLING DEVICE

BACKGROUND OF THE INVENTION

This invention relates to a device for disabling a shotgun.

SUMMARY OF THE PRIOR ART

Devices for disabling guns have been proposed in, for example, U.S. Pat. No. 3,137,957 which comprise a rod like member which extends from one end of the barrel to the other. At one end of the barrel, an opening is provided through which in use a staple of a padlock extends to prevent the member being removed from a chamber end of the barrel. At the chamber end of the barrel there is provided a cartridge shaped end portion.

Such devices have the disadvantage that if the firing mechanism of the gun is actuated with the device in place, there is a risk of damaging the delicate firing mechanism as a hammer of the firing mechanism engages the cartridge shaped end portion.

Accordingly it is an object of the invention to provide a new or improved disabling device specifically for a shotgun.

SUMMARY OF THE INVENTION

According to one aspect of the invention we provide a disabling device for a shutgun comprising a barrel having a chamber end and a muzzle end, and a firing mechanism including a hammer, the disabling device comprising a generally elongate and rigid disabling member having an opening therethrough towards a first end of the member, and there being a cap secured to a second end of the disabling member, the cap having an outwardly extending flange and the disabling member being adapted to be received in the barrel of the shotgun by inserting the first end of the disabling device into the chamber end of the barrel and relatively moving longitudinally the barrel and the disabling member until the flange of the cap engages the chamber end of the barrel, with at least part of the opening extending from the muzzle end of the barrel, the cap comprising a sprung element which projects from an end of the cap to a position where the element would be struck by the hammer of the shotgun firing mechanism in the event that the firing mechanism is actuated with the disabling device received in the barrel.

Thus the present invention overcomes the problems of the prior art device in that in the event of the firing mechanism of a shutgun being actuated with the disabling member received in the barrel, the hammer will strike the sprung element thus protecting the firing mechanism from damage.

In another aspect, the invention resides in the combination of a shotgun and a disabling device for the shotgun, wherein the shotgun comprises a barrel having a chamber end and a muzzle end and a firing mechanism including a hammer, the disabling device comprising a generally elongate and rigid disabling member having an opening therethrough towards a first end of the member and there being a cap secured to a second end of the disabling member, the cap having an outwardly extending flange and in use, the disabling member being received in the barrel of the shotgun with the flange of the cap engaging the chamber end of the barrel with at least part of the opening extending from the muzzle end of the barrel, the cap comprising a sprung element which projects from an end of the cap to a position where the element would be struck by the hammer of the shotgun in the event that the firing mechanism is actuated, part of a lock extending through the opening projecting from the muzzle end of the barrel.

BRIEF DESCRIPTION OF THE DRAWINGS

The invention will now be described with the aid of the accompanying drawings in which.

DESCRIPTION OF THE PREFERRED EMBODIMENTS

Figures 1, 2:
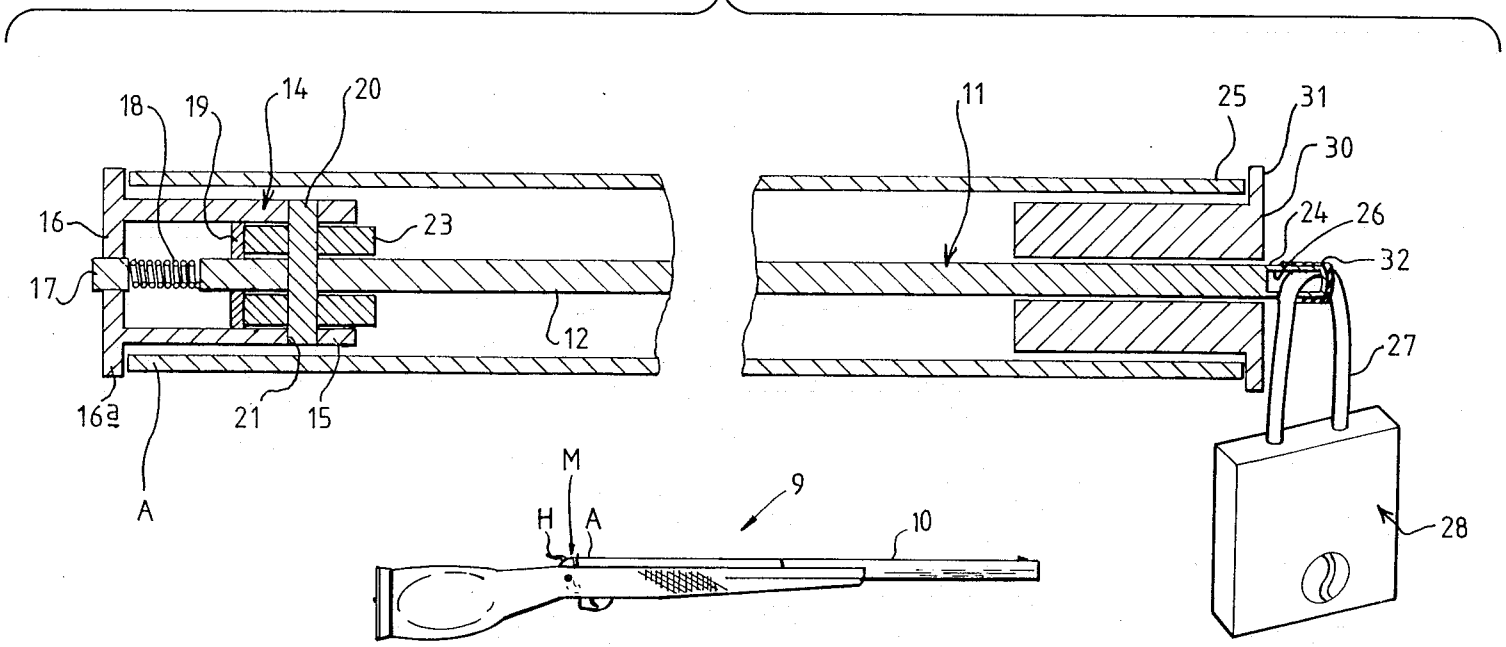
FIG. 1 is an illustrative view of a shotgun.
FIG. 2 is an illustrative cross-section through the barrel of the shotgun of FIG. 1 which is disabled by a device according to the invention.

Referring to the drawings there is shown a shotgun 9 having a barrel 10 in which in FIG. 2 is received a disabling device 11 which prevents the shotgun 9 being fired.

The disabling device 11 comprises a rod 12 or other generally rigid and elongate disabling member which extends along the length of the barrel 10 and is secured at one end to a cap 14 which resembles a cartridge. The cap 14 has a body 15 of generally cylindrical configuration and an end surface 16 which provides a flange **16*a* which extends radially outwardly of the body 15. The flange 16*a* engages and closes a chamber end A of the barrel 10. In a generally central position of the end surface 16, there is an element 17 which is spring biased outwardly of the surface 16 by a spring 18 within the cap 14 which bears on a bearing part 19 of the cap 14 so that in the event that a firing mechanism M of the shotgun 9 is actuated, (e.g. if a trigger of the shotgun 9 is pulled with a hammer H cocked), the hammer H of the firing mechanism will strike the sprung element 17 rather than the solid surface 16. The element 17** thus protects the firing mechanism against damage as could otherwise occur to the firing mechanism M.

The rod 12 is permanently and rigidly secured to the cap 14 by means of a transversely extending locking pin 20 which extends diametrically across the body 15 of the cap 14 and engages in aligned openings 21 in the body 15.

A sleeve 23 is provided which fills a space between the rod 12 and the internal surface of the cylindrical body 15.

Of course, in an alternative construction, the sleeve 23 may not be required where the cap 14 and/or rod 12, are dimensioned or confiqured so as to provide a better fit between the rod 12 and the cap 14. Further alternatively, if desired, the rod 12 may be secured to the cap 14 by means other than a transversely locking pin 20 as described.

The other, end 24 of the rod 12 projects from a muzzle end 25 of the barrel 10 and has an opening 26 through which is received a staple 27 of a locking means comprising in this example, a padlock 28. Any other suitable locking means may be provided which co-operates with the opening 26.

Between the rod 12 and the barrel 10 at the muzzle end 25 of the barrel 10, there is a sleeve 30 to prevent the rod 12 engaging the barrel 10, the sleeve 30 having an outwardly extending flange 31 which protects the end 25 of the barrel 10 as the padlock 28 or other locking means is engaged and disengaged with the opening 26 of the rod 12.

It will be appreciated from the foregoing description that it is not possible to remove the disabling member 11 from the chamber end A of the barrel 10 in which a cartridge is usually inserted by virtue of the padlock 28 or other locking means at the muzzle end 25 of barrel 10, and it is not possible to withdraw the member 11 from the muzzle end 25 of the barrel 10 because of the outwardly extending flange 16a of the cap 14.

Thus it will be appreciated that when the member 11 is in position and is locked by the padlock 28 or other locking means, it is not possible for an unauthorised person without a key to padlock 28 readily to remove the member 11 and hence render the gun able for firing.

With the shotgun "broken", the disabling device 11 is received into the barrel 10, by inserting the end 24 of rod 12 into the chamber end A of the barrel 10 and then relatively moving longitudinally the barrel 10 and the rod 12 until the flange 16a engages the chamber end A, with the opening 26, or at least part of the opening 26 projecting from the muzzle end 25 of the barrel 10.

Various modifications may be made without departing from the scope of the invention.

In the present example, the cap 14 is preferably made of brass but could be made of another material as required and in a different configuration. The rod 12 may be made of metal or plastics as desired, although if the rod is made of plastics, it is preferred that the end 24 of the rod which extends from the muzzle end 25 of the barrel 10 is at least strengthened. In the arrangement shown, the projecting end 24 of the rod 12 has a protective cover 32 of a relatively soft material e.g. plastics which protects the internal surface of the barrel 10 as the rod 12 is inserted. This may not be required if the entire rod 12 is made of plastics for example.

The length of rod 12 may be adjustable to enable the device 11 to be used with shotguns 9 of different barrel length, or the end 24 may comprise a series of openings, through any appropriate one of which the staple 27 may be passed.

The invention is particularly applicable to a shotgun because it is possible readily to insert the member 11 along the barrel 10 from the chamber end of the barrel 10 in which a cartridge is conventionally inserted because the shotgun can be "broken".

The present invention has a further advantage in that the barrel 10 may be removed from the remainder of the shotgun 9 without having to remove the disabling device therefrom.

I claim:

1. A disabling device for a shotgun comprising a barrel having a chamber end and a muzzle end, and a firing mechanism including a hammer, the disabling device comprising a generally elongate and rigid disabling member having an opening therethrough towards a first end of the member, and there being a cap secured to a second end of the disabling member, the cap having an outwardly extending flange, the disabling member being adapted to be received in the barrel of the shotgun by inserting the first end of the disabling device into the chamber end of the barrel and relatively moving longitudinally the barrel and the disabling member until the flange of the cap engages the chamber end of the barrel, with at least part of the opening extending from the muzzle end of the barrel, the cap comprising a sprung element which projects from an end of the cap to a position where the element would be struck by the hammer of the shotgun in the event that the firing mechanism is actuated with the disabling device received in the barrel.

2. A device according to claim 1 wherein the disabling member comprises a rod and the cap comprises a generally cylindrical body with the outwardly extending flange being provided at the end.

3. A device according to claim 1 wherein a sleeve is interposed between the rod and the cap and a locking pin extends through the rod and into engagement with the body and the sleeve to secure the rod to the cap part.

4. A device according to claim 1 which includes a sleeve which is adapted to be received on the projecting end of the disabling member and fits into the muzzle end of the barrel, the sleeve including an outwardly extending flange to protect the muzzle end of the barrel.

5. A device according to claim 1 wherein the first end of the disabling member has a covering of a soft material to protect the inside of the barrel as the disabling member is inserted.

6. A combination of a shotgun and a disabling device for a shotgun, the shotgun comprising a barrel having a chamber end and a muzzle end, and a firing mechanism including a hammer, the disabling device comprising a generally elongate and rigid disabling member having an opening therethrough towards a first end of the member and there being a cap secured to a second end of the disabling member, the cap having an outwardly extending flange and in use the disabling member being received in the barrel of the shotgun with the flange of the cap engaged with the chamber end of the barrel and at least part of the opening extending from the muzzle end of the barrel, the cap comprising a sprung element which projects from an end of the cap to a position where the element would be struck by the hammer of the shotgun in the event that the firing mechanism is actuated, part of a lock extending through the opening projecting from the muzzle end of the barrel.

7. A combination according to claim 6 wherein the part of the lock comprises a staple and the lock is padlock.

8. A method of disabling a shotgun comprising a barrel having a chamber end and a muzzle end, and a firing mechanism including a hammer, the method comprising receiving a generally elongate and rigid disabling member of a disabling device in the barrel by inserting a first end of the disabling member into the chamber end of the barrel and relatively moving longitudinally the barrel and the disabling member until at least part of an opening through the disabling member towards a first end of the disabling member extends from the muzzle end of the barrel and an outwardly extending flange of a cap secured to a second end of the disabling member engages the chamber end of the barrel, and inserting part of a lock through the opening projecting from the muzzle end of the barrel and securing the lock against removal by an unauthorised person.

* * * * *